US006370822B1

(12) United States Patent
Otto

(10) Patent No.: US 6,370,822 B1
(45) Date of Patent: Apr. 16, 2002

(54) REVOLVING DOOR

(75) Inventor: Gertjan Otto, Purmerend (NL)

(73) Assignee: Boon Edam B.V., Edam (NL)

( * ) Notice: Subject to any disclaimer, the term of this patent is extended or adjusted under 35 U.S.C. 154(b) by 0 days.

(21) Appl. No.: 09/423,928

(22) PCT Filed: Apr. 10, 1998

(86) PCT No.: PCT/NL98/00207

§ 371 Date: Feb. 23, 2000

§ 102(e) Date: Feb. 23, 2000

(87) PCT Pub. No.: WO98/51896

PCT Pub. Date: Nov. 19, 1998

(30) Foreign Application Priority Data

May 14, 1997 (NL) ..... 1006050

(51) Int. Cl.[7] ..... E05D 15/02
(52) U.S. Cl. ..... 49/42; 49/43
(58) Field of Search ..... 49/42, 43, 100, 49/138, 44; 109/6, 8

(56) References Cited

U.S. PATENT DOCUMENTS

| | | | | |
|---|---|---|---|---|
| 4,976,065 A | * 12/1990 | Beran et al. | ..... | 49/43 |
| 5,711,111 A | * 1/1998 | Nyffenegger et al. | ..... | 49/44 |

FOREIGN PATENT DOCUMENTS

| | | | | |
|---|---|---|---|---|
| DE | 3008782 | * 10/1980 | ..... | 49/42 |
| DE | 4425047 | * 1/1996 | | |
| EP | 799962 | * 10/1997 | | |
| FR | 2687722 | * 8/1993 | | |
| FR | 2610361 | * 8/1998 | ..... | 49/42 |
| GB | 2119429 | * 11/1983 | | |

* cited by examiner

*Primary Examiner*—Jerry Redman
(74) *Attorney, Agent, or Firm*—Kinney & Lange, P.A.

(57) ABSTRACT

A revolving door has driven door panels, which are movably positioned around a central rotating element. Each pair of door panels has an individual drive. The driving speed for each door panel is chosen on the basis of the position taken by said door panel in its path of rotation.

15 Claims, 2 Drawing Sheets

REVOLVING DOOR

BACKGROUND OF THE INVENTION

The invention relates to a revolving door provided with driven door panels which are movably positioned around a central rotating element. A revolving door of this kind is known from DE-A-44 25 047, wherein each door panel has an individual drive.

The known revolving door is characterized in that as central rotating element a circular rotation shaft is applied around which four door panels rotate under the influence of separate linear driving motors.

Another known revolving door is characterized in that as central rotating element an elongated shaft is applied, one thing and another being arranged such that at both sides of said shaft there are side walls which together with the shaft form two passages through which the door panels can move.

A disadvantage of said known embodiments of the revolving door is that its dimensions, and in particular the side walls' length of circumference, are determined by the circumstances. This is especially the case where the embodiment is provided with a central rotation shaft and the side walls have the form of circle segments. With the revolving door according to the prior art the dimensions of said side walls are by necessity such that during rotation of the door panels there is always at least one pair of door panels to block the free passage for the sake of draught exclusion. As a consequence, the diameter of the revolving door also determines the dimensions required for the side walls. It is the object of the invention to provide greater freedom of design while providing the possibility to guarantee draught exclusion independent of situational conditions with respect to the available dimensions of the revolving door and the surroundings in which it is to be used.

SUMMARY OF THE INVENTION

To this end the revolving door according to the invention is characterized in that the driving speed for each door panel is chosen on the basis of the position taken by said door panel in its path of rotation. By this surprisingly simple measure the positioning of the separate door panels can be adjusted to one another under all conditions of use such as to fulfil all the utilization requirements of the revolving door.

In a particular embodiment of the revolving door according to the invention each pair of door panels may be provided with an individual drive. The door panels forming a pair should then be arranged symmetrically in relation to one another and in relation to the central rotating element.

A revolving door according to the invention that is in operation distinguishes itself from a revolving door of the prior art by the fact that the door panels no longer have a uniform rotation speed, but that said rotation speed may vary during the rotation around the central rotation element. Desirably the drive speed of the door panels is then varied such that during normal operation there is always at least one pair of door panels forming a draught exclusion between the central rotating element and the side walls.

In a further aspect, the revolving door according to a preferred embodiment of the invention is characterized in that an input device is provided for indexing a panic position or a summer position, and that when the input device is activated, the drives of the door panels are equipped to move said door panels to, and maintain them in a position so as to provide a free passage.

BRIEF DESCRIPTION OF THE DRAWINGS

The invention will now be explained in more detail with reference to the drawing in which:

Identical parts in the Figures are referred to by the same reference numbers.

FIG. 1 shows schematically a revolving door according to the prior art, provided with uniformly driven door panels 1 and 2 which rotate around a central rotation shaft 3 between a left side wall 4 and a right side wall 5. The door panels 1 lie in one another's extended direction and form a pair as do the door panels 2. The pair of door panels 1 and the pair of door panels 2 are maintained at a right angle, one thing and another being arranged such that when the ends of the door panels 2 leave the side walls 4 and S at the point indicated by the arrows A, the door panels 1 will already have reached said side walls 4 and 5 at the points indicated by arrows B, so that during this normal operation continuous draught exclusion in the passage is guaranteed. According to the invention, the uniform and synchronous movement of the (pairs of) door panels 1 and 2 is discontinued by the fact that each door panel 1 or 2 respectively, is provided with an individual drive, as will be further elucidated with reference to the FIGS. 2*a*–2*c* and 3*a*–3*b*. In the embodiment to be discussed below, the pairs of door panels 1 or 2 respectively are provided with an individual drive. This makes the manner of operation possible which is explained in more detail with reference to the FIGS. 2*a*–2*c*.

Figure 2A:
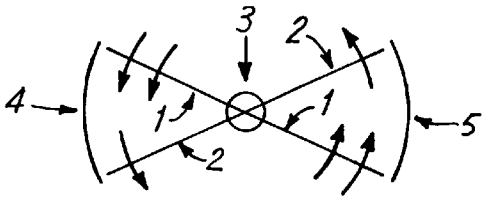
FIGS. 2*a*–2*c* represent a schematic organigram of a first embodiment of a revolving door according to the invention.
Figure 2B:
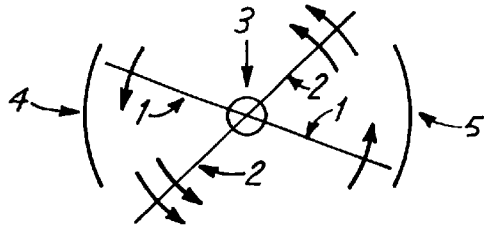
Figure 2C:
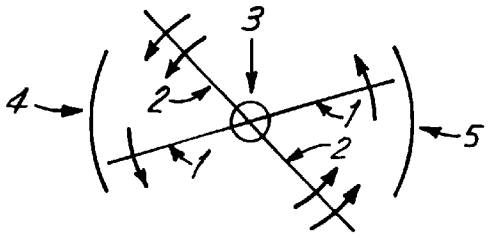

In order to guarantee the continuous draught exclusion, the revolving door according to a preferred embodiment of the invention is characterized in that always at least one pair of door panels 1 or 2 respectively forms a draught exclusion between the central rotation element 3 and the side walls 4 and 5. As soon as one pair of door panels 2 leaves the side walls 4 and 5, as shown in FIG. 2*a*, for instance, another pair of door panels 1 has to have arrived at the side walls 4 and 5. As the side walls 4 and 5 according to the invention may have a shorter circumferential length than is the case in the prior art, the door panels 1 have to arrive at the side walls 4 and 5 with increased speed (symbolized by a double speed vector) after which it is possible to change down to normal rotation speed (symbolized by a single speed vector), as shown in FIG. 2*b*. Subsequently (as also shown in FIGS. 2*b* and 2*c*), the door panels 2 which have just left the side walls 4 and 5 must then move with increased speed in order to arrive in time at the side opposite to the side walls 4 and 5. In time means, that the door panels 2 arrive not later than the moment when the door panels 1, which are rotating with normal speed between the side walls 4 and 5, are on the point of leaving said side walls 4 and 5. Therefore, in accordance with the invention, the drive speed of each door panel 1 and 2 must be chosen such that said speed depends on the position taken by the respective door panel 1 or 2 in its path of rotation.

Figure 2D:
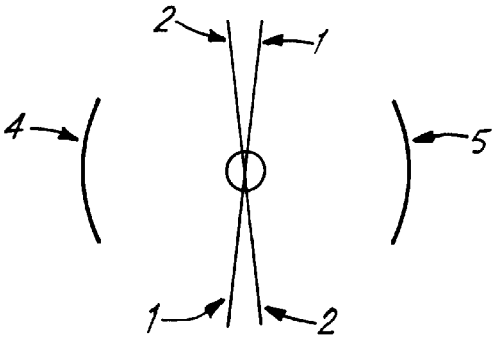
FIG. 2*d* shows a panic position of the revolving door in its first embodiment.

FIG. 2*d* shows the situation occurring in case of a panic situation or an optional summer position of the revolving door. For this purpose the revolving door according to the invention is provided with an input device (not shown) for indexing a panic situation or the summer position, wherein one thing and another is established such that when the input device is activated, the drives of the door panels 1 and 2 will move said door panels to and maintain them in a position which provides a free passage.

Figure 3A:
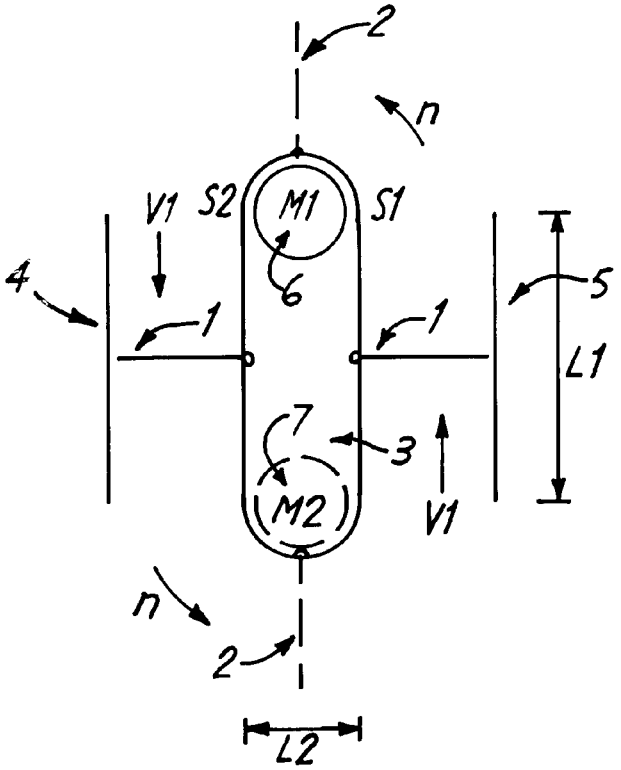
FIGS. 3*a*–3*b* show a second embodiment of a revolving door according to the invention in a schematic top and front view.
Figure 3B:
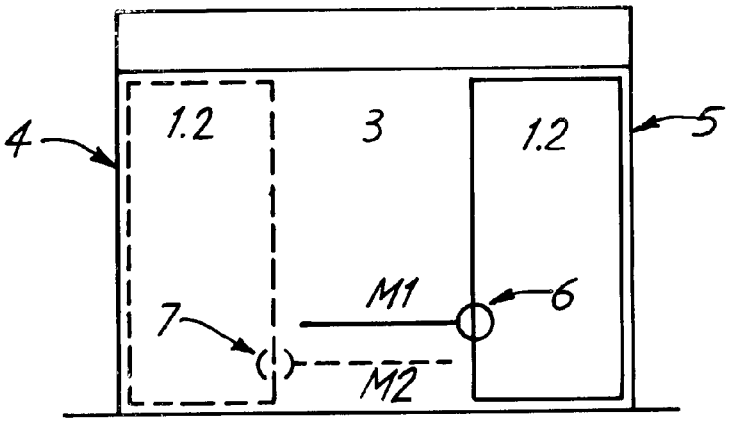

FIGS. 3*a*–3*b* show another alternative embodiment of the revolving door according to the invention, namely one in which a central rotation element 3 is provided in the form of an elongated shaft, both sides of which together with the side walls 4 and 5 define two passages through which the door panels 1 or 2 respectively can move. FIGS. 3*a*–3*b* indicate schematically a first drive 6 and a second drive 7 by means of which the pair of door panels 2 and the pair of door panels 1 respectively, are moved around the central rotating element. The use of these separate drive elements 6 and 7 allows the pairs of door panels 1 and 2 to be moved independently of each other and therefore with an individually determined and instantaneously adjustable rotating speed. As a result the dimensions of the side walls 4 and 5 may be chosen from a wide range of possible dimensions while the characteristics making the use of a revolving door appealing, such as draught exclusion, remain in force. Further advantages that have been gained with the revolving door according to the invention may be found in the fact that when a door panel rotates between the left passage and the right passage the rotating speed of the respecting door panel may be temporarily increased to compensate the greater distance it has to travel at that moment due to the curve.

If a situation should arise to occasion such a need, the revolving door according to the invention is in all its embodiments also very functional as safety door as the drive of the separate door panels 1 and 2 can be blocked.

With regard to the embodiment shown in FIGS. 3*a*–3*b* it should be mentioned that in the event of a panic situation or to comply with the wish for a summer position, the separate door panels 1 and 2 can be arranged such as to provide two parallel free passages. However, the most important advantage of the invention is that the separate drive for the door panel pairs 1 and 2 affords freedom of design for the entire construction of access to the building in which the revolving door is applied, providing in particular the free choice regarding the dimensions of the various components of the construction of access.

It will be clear to the person skilled in the art that within the scope of the appended claims sundry variations are conceivable and that the above merely serves to elucidate the content of said claims.

What is claimed is:

1. A revolving door with driven door panels which are movably positioned around a central rotating element, characterized in that a driving speed for each drive door panel is chosen based on a position taken by said driven door panel in its path of rotation, in that the driven door panels are provided in pairs, and in that each pair of door panels is provided with a drive.

2. A revolving door according to claim 1, characterized in that the door panels forming a pair are arranged symmetrically in relation to one another and in relation to the central rotating element.

3. A revolving door according to claim 3 further comprising side walls, such that each door panel positioned between a side wall and the central rotation element forms a draught exclusion, characterized in that the drive speed of the door panels is varied such that during normal operation there is always at least one pair of door panels forming a draught exclusion between the central rotating element and the side walls.

4. A revolving door according to claim 4 characterized in that an input device is provided for indexing a panic situation or a summer position, and that when the input device is activated, the drives of the door panels are equipped to move said door panels to, and maintain them in a position so as to provide a free passage.

5. A revolving door according to claim 1 characterized in that an input device is provided for indexing a panic situation or a summer position, and that when the input device is activated, the drives of the door panels are equipped to move said door panels to, and maintain them in a position so as to provide a free passage.

6. The revolving door according to claim 1, wherein the driving speed of each pair of driven door panels is separately adjustable such that an angle between said pairs of driven door panels varies during operation.

7. The revolving door according to claim 1, wherein the driven door panels maintain a continuous draught exclusion.

8. A revolving door comprising:

a central rotation element;

a plurality of driven door panels, each driven door panel being separately moveable around the central rotation element, wherein the plurality of driven door panels are comprised of pairs of driven door panels; and motors for each pair of driven door panels;

wherein a driving speed for each driven door panel varies automatically based on a current position around the central rotating element of the driven door panel in its path of rotation.

9. A revolving door according to claim 8, wherein the driven door panels forming a pair are arranged symmetrically about the central rotating element and are positioned symmetrically in relation to one another.

10. A revolving door according to claim 9 further comprising:

side walls separated from the central rotating element by approximately a width of the driven door panel, such that the pair of driven door panels positioned between the side walls and the central rotation element forms a draft exclusion, wherein the drive speed of each pair of driven door panels varies to ensure the draft exclusion by at least one of the pairs of driven door panels during normal operation.

11. A revolving door according to claim 10 further comprising:

an input device for indexing a fully open position, the input device providing a signal to the drives of the pairs of driven door panels, the signal causing the drives to move the pairs of driven door panels into the fully open position and to maintain the driven door panels in the fully open position so as to remove the draft exclusion and to provide a free passage.

12. A revolving door according to claim 8 further comprising:

an input device for indexing a fully open position, the input device providing a signal to the drives of the driven door panels, the signal causing the drives to move the driven door panels into the fully open position and to maintain the driven door panels in the fully open position so as to remove the draft exclusion and to provide a free passage.

13. The revolving door according to claim 8, wherein the driving speed of each pair of driven door panels is separately adjustable such that an angle between the pairs of driven door panels varies during operation.

14. The revolving door according to claim 8, wherein the driven door panels maintain a continuous draft exclusion.

15. The revolving door according to claim 8, further comprising:

side walls separated from the central rotation element by approximately a width of the driven door panel, each side wall extending circumferentially about the central rotation element in an arc length of less than the width of the driven door panel multiplied by $\pi/2$.

* * * * *

UNITED STATES PATENT AND TRADEMARK OFFICE

CERTIFICATE OF CORRECTION

PATENT NO. : 6,370,822 B1
DATED : April 16, 2002
INVENTOR(S) : Gerjan Otto

Figure 1:
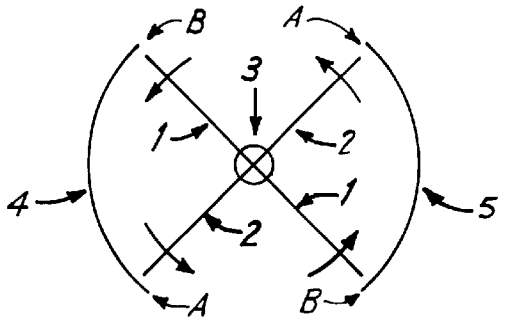
FIG. 1 PRIOR ART
FIG. 1 is a schematic illustration of the revolving door according to the prior art.

It is certified that error appears in the above-identified patent and that said Letters Patent is hereby corrected as shown below:

Column 2,
Line 20, delete "S", insert -- 5 --
Line 60, insert the following paragraph before the last paragraph
-- As depicted in Figs. 2A-2D, side walls 4 and 5 are separated from the central rotation element 3 by approximately a width of the driven door panel 1, 2. Each side wall 4, 5 extends circumferentially about the central rotation element 3 in an arc length less than that of the prior art shown in Fig. 1. Namely, each side wall 4, 5 extends circumferentially about the central rotation element 3 less than 90°, in an arc length less than the width of the driven door panel multiplied by $\pi/2$. --

Column 3,
Line 46, after "door", insert -- provided --
Line 48, delete "drive", insert -- driven --

Signed and Sealed this

Fourth Day of February, 2003

JAMES E. ROGAN
*Director of the United States Patent and Trademark Office*